United States Patent [19]

Hodshon

[11] 4,163,381

[45] Aug. 7, 1979

[54] METHOD AND APPARATUS FOR MAKING A TROPHY COLUMN

[76] Inventor: Jack R. Hodshon, 2363 Cecelia La., Clearwater, Fla. 33515

[21] Appl. No.: 916,771

[22] Filed: Jun. 19, 1978

[51] Int. Cl.[2] ..... B21D 31/00

[52] U.S. Cl. ..... 72/477; 72/379; 72/457; 72/469

[58] Field of Search ..... 72/457, 458, 469, 463, 72/379; 140/106

[56] References Cited

U.S. PATENT DOCUMENTS

| | | | |
|---|---|---|---|
| 1,093,320 | 4/1914 | Dieckman | 72/477 |
| 1,160,467 | 11/1915 | Tidwell | 72/477 |
| 1,479,741 | 1/1924 | Reitz | 72/458 |
| 1,517,198 | 11/1924 | Deemer | 72/477 |
| 3,041,900 | 7/1962 | Wagner | 72/457 |

*Primary Examiner*—Leon Gilden

[57] ABSTRACT

A metal working hand tool and a method for its use are disclosed for making a two piece, four sided, metal trophy column. The first column part is a housing formed with a first piece of sheet metal forming three sides of the column with longitudinal clasp portions at the terminating edges of the first and third of these sides. The second column part is a decorative insert formed from a second piece of sheet metal forming the fourth one of the sides of the column, having longitudinal clasp engaging portions at the terminal edges thereof which engage the clasps on the housing. The hand tool is an L shaped body with a first slot in the short segment thereof for securing a first end of the first piece of sheet metal while it is being sequentially bent over the adjacent sides of the body forming the three sided housing with its longitudinal clasp portions. A second slot in the L shaped body secures a first end of the second piece of sheet metal while it is being sequentially bent over adjacent sides of the body, thereby forming the decorative insert with its longitudinal clasp engaging portions. The disclosed tool and method for its use provide a simplified and inexpensive means for making a two piece trophy column.

7 Claims, 21 Drawing Figures

FIG. 1
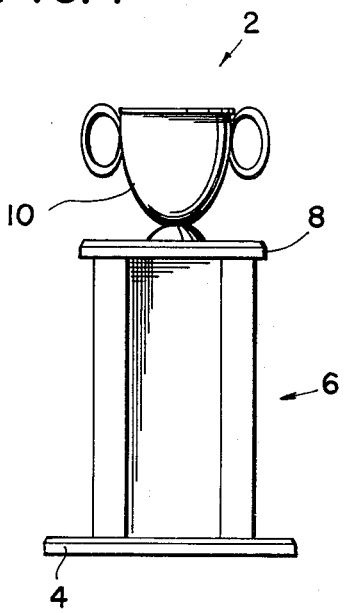
FIG. 2
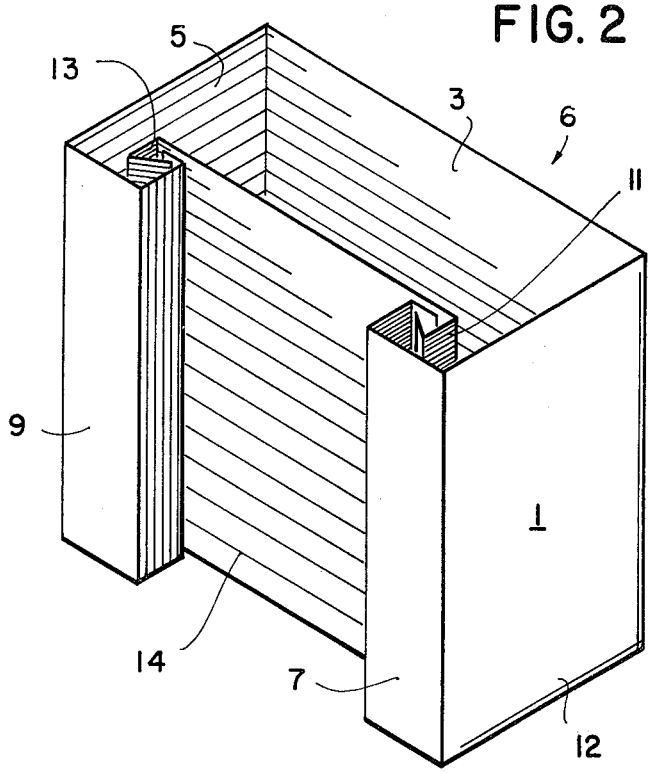
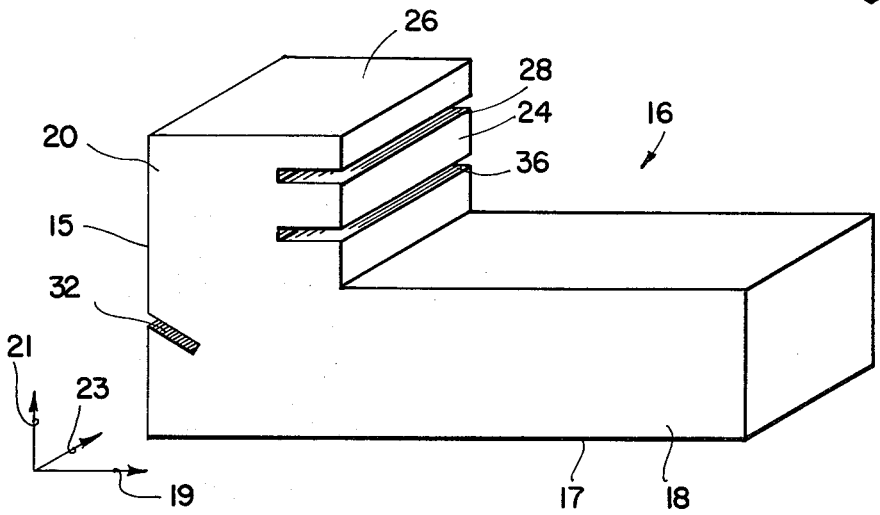
FIG. 3
FIG. 7
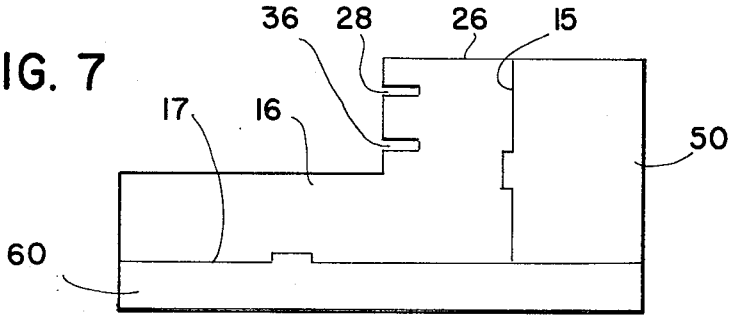

FIG. 5a
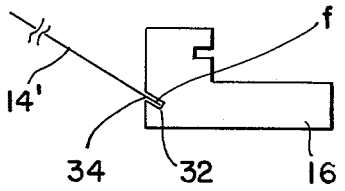
FIG. 5d
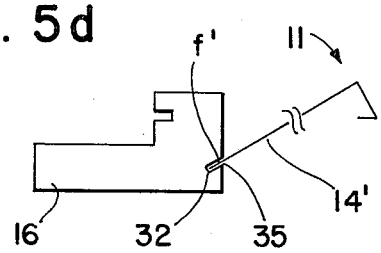
FIG. 5b
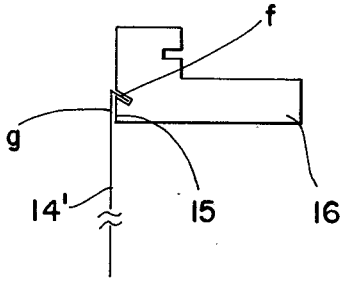
FIG. 5e
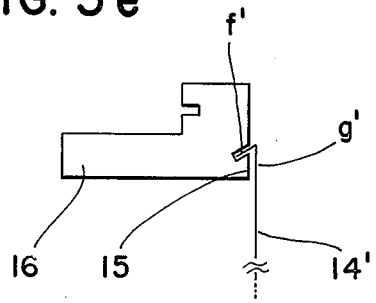
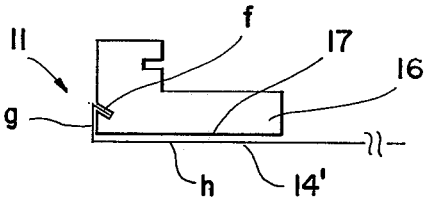
FIG. 5c
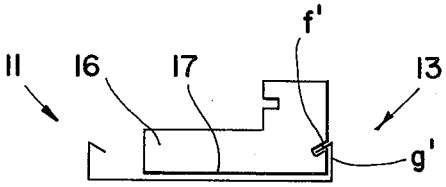
FIG. 5f
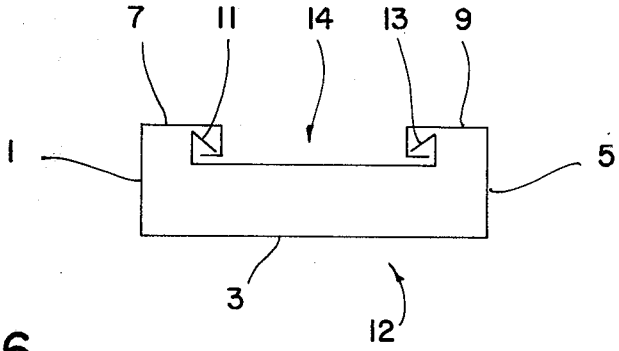
FIG. 6

METHOD AND APPARATUS FOR MAKING A TROPHY COLUMN

FIELD OF THE INVENTION

The invention disclosed broadly relates to metal working and more particularly relates to a hand tool and method for making a metal trophy column.

BACKGROUND OF THE INVENTION

The modern day sports trophy has its origins in the battlefield trophies erected by the ancient Greeks in memorial of a military victory, where captured arms and standards were hung upon a tree or stake and were inscribed with the details of the battle and dedicated to the Gods. The Romans took over the custom and modified their trophies to take the form of columns or triumphal arches. The custom of commemorating victories with trophies has come down to modern times when sports victories are honored by the giving of a decorative sports trophy, usually with a description of the victory to be commemorated.

Modern sports trophies are made out of a variety of materials including metal and wood and generally take the form of a columnar structure such as shown in FIG. 1, mounted upon a base 4 with a column 6 supporting a top platform 8 upon which may be mounted a victory cup, figure, or other insignia. Heretofore, complex metal working techniques have been employed to form the column portions 6, requiring the support of large scale metal working machinery. A need has arisen for a more simplified approach to making sports trophies, which may be operated by the proprietor of a sports store, for example, providing a quicker response time for supplying the sports trophy to the customer and enabling the manufacturing cost thereof to be substantially reduced.

OBJECTS OF THE INVENTION

It is therefore an object of the invention to provide an improved means for making a sports trophy.

It is still another object of the invention to provide an improved tool for making a sports trophy.

It is still a further object of the invention to provide a low cost inexpensive tool and method for making a columnar trophy.

SUMMARY OF THE INVENTION

These and other objects, features and advantages of the invention are accomplished by the method and tool for making a metal trophy column, disclosed herein. A metal working hand tool and a method for its use are disclosed for making a two piece, four sided, metal trophy column. The first column part is a housing formed with a first piece of sheet metal forming three sides of the column with longitudinal clasp portions at the terminating edges of the first and third of these sides. The second column part is a decorative insert formed from a second piece of sheet metal forming the fourth one of the sides of the column, having longitudinal clasp engaging portions at the terminal edges thereof which engage the clasps on the housing. The hand tool is an L shaped body with a first slot in the short segment thereof for securing a first end of the first piece of sheet metal while it is being sequentially bent over the adjacent sides of the body forming the three sided housing with its longitudinal clasp portions. A second slot in the L shaped body secures a first end of the second piece of sheet metal while it is being sequentially bent over adjacent sides of the body, thereby forming the decorative insert with its longitudinal clasp engaging portions. The disclosed tool and method for its use provide a simplified and inexpensive means for making a two piece trophy column.

DESCRIPTION OF THE FIGURES

These and other objects, features and advantages of the invention will be more fully appreciated with reference to the accompanying drawings.

FIG. 1 is an elevational view of a sports trophy.

FIG. 2 is an isometric view of the structure of the two-piece column for a trophy, made with the subject invention.

FIG. 3 is a frontal view of the inventive tool for making the two-piece column for a trophy.

FIGS. 5*a*–5*f* show the sequence of steps necessary to form the insert 14 for the trophy column in FIG. 2.

FIG. 6 is a top cross-sectional view of the assembled columnar portion of the trophy of FIG. 2.

FIG. 7 is an illustration of a modified embodiment of the tool shown in FIG. 3.

DISCUSSION OF THE PREFERRED EMBODIMENT

Figure 4A:
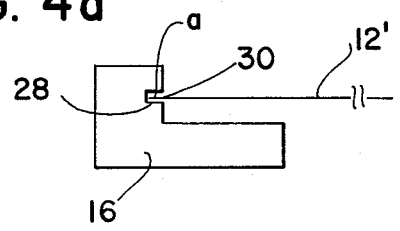
FIGS. 4*a*–4*j* illustrate the sequential steps in bending a first sheet metal piece so as to form the housing 12 for the trophy column shown in FIG. 2.
Figure 4F:
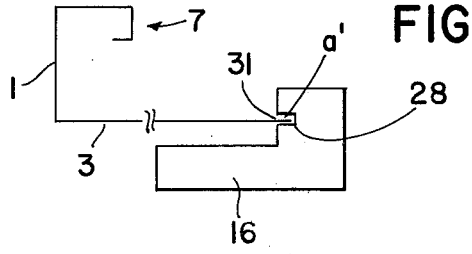
Figure 4B:
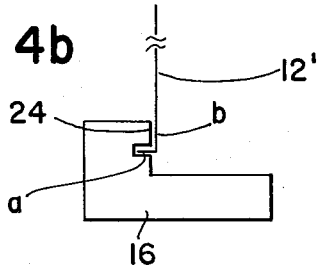
Figure 4G:
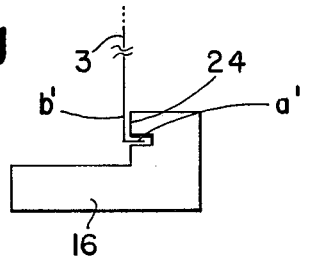
Figure 4C:
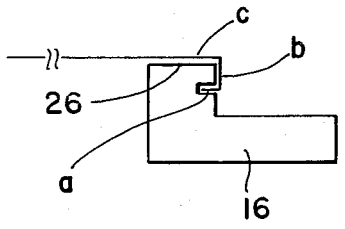
Figure 4H:
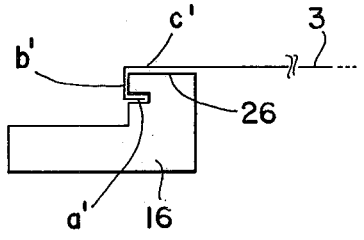

An overall view of a sports trophy 2 is shown in FIG. 1, where the column portion 6 is mounted on the base 4 and supports the top portion 8 upon which is mounted a victory cup 10. It is the fabrication of the column portion 6 which is addressed by the subject invention. A view of the column portion 6 is shown in FIG. 2, wherein it is seen that the column is formed of two pieces, a housing portion 12 and an insert portion 14. The two piece four sided metal trophy column 6 has a housing 12 formed from a first piece of sheet metal 12', having three sides 1, 3 and 5, with longitudinal clasp portions 7 and 9 at the terminating edges of the first and third sides 1 and 5. The decorative insert portion 14 is formed from a second piece of sheet metal 14' forming the fourth side of the column, with longitudinal clasp engaging portions 11 and 13 at the terminating edges thereof which engage the clasps 7 and 9, respectively, on the housing 12.

FIG. 3 illustrates the metal forming hand tool which, in accordance with the invention, enables the manual fabrication of both the housing portion 12 and the decorative insert portion 14 of the column 6. The tool is an L shaped body 16 having a long handle segment 18 with a principal outside surface 17 along a length direction 19. A short metal engaging segment 20 has a principal outside surface 15 along a width direction 21 which is perpendicular to the length direction 19. The L shaped body has a depth along a longitudinal direction 23 which is mutually perpendicular the length and width directions and should be at least as long in the depth direction as the vertical height of the column 6 to be formed thereby. The short, metal engaging segment 20 has an inside surface 24 parallel to the principal outside surface 15 of the short segment and it also has an end surface 26 which is parallel with the principal outside surface 17 of the long segment 18.

Figure 4D:
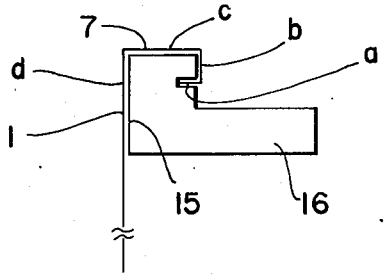
Figure 4I:
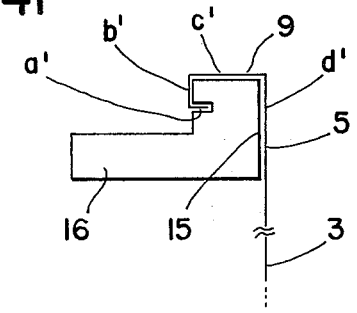
Figure 4E:
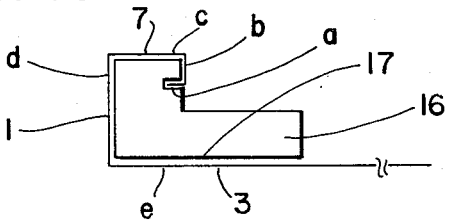

Reference should now be made to the sequence of FIGS. 4*a*–4*j*, along with FIG. 3, to illustrate how the tool is employed to form the housing portion 12 of the column 6. A first slot 28 is located in the inside surface of the short segment 20, parallel with the end surface 26, having a depth approximately equal to the length of the first segment a of the longitudinal clasp portion 7. The first slot 28 is located at a distance from the end surface 26 approximately equal to the length of the second segment b of the longitudinal clasp portion 7. The first slot 28 secures a first end 30 of the first piece of sheet metal 12' as shown in FIG. 4*a*, while it is being sequentially bent over the inside surface 24, the end surface 26 as in FIG. 4*b*, and the outside surface 15 of the short segment 20 as in FIG. 4*c*, and over the outside surface 17 of the long segment 18, as is shown in FIG. 4*d*, thereby forming one of the longitudinal clasp portions 7 on one edge of the first side 1 of the housing 12. FIG. 4*e* shows the state of formation of the housing 12 after the first clasp 7 and first side 1 are formed by the operator having held the tool 16 in one hand by means of the handle portion 18 and bending the first end 30 of the first sheet metal piece 12' about the tool 16 with the other hand.

FIGS. 4*f*–4*j* show the balance of the operation for using the tool 16, where the opposite end 31 of the sheet metal piece 12', is inserted into the slot 28 and a comparable sequence of steps, as is shown in FIGS. 4*g*, 4*h*, 4*i* and 4*j*, takes place, thereby forming the clasp portion 9.

The inside surface 24 and the outside surface 15 of the short segment 20 are separated by a distance approximately equal to the length of a third segment c of the longitudinal clasp portion 7. The end surface 26 of the short segment 20 and the outside surface 17 of a long segment 18 are separated by a distance which is approximately equal to the length of the first side 1 of the housing 12.

Representative values for the dimensions of the tool 16 are a=0.187 inches, b=0.170 inches, c=0.437 inches, d=1.000 inches, and the length of the long segment 18 is 1.500 inches. Various other combinations of dimensions may be chosen to form trophies of other sizes. The depth dimension 23 for the tool 16 may be from 12 to 15 inches long.

Reference to the sequence of FIGS. 5*a*–5*f* will illustrate how the tool 16 is applied in the formation of the decorative insert 14. A second slot 32 is located in the outside surface 15 of the short segment 20 and has an opening which is parallel to the outside surface 17 of the long segment 18. The second slot 32 has a depth approximately equal to the length of a first segment f of the longitudinal clasp engaging portion 11 for the decorative insert 14. The depth of the second slot 32 is at an acute angle of approximate 30° with respect to the outside surface 17 of the long segment 18. The second slot 32 is located at a distance from the outside surface 17 of the long segment 18 which is approximately equal to the length of a second segment g of the longitudinal clasp engaging portion 11. The second slot 32 secures a first end 34 of a second piece of sheet metal 14' as is shown in FIG. 5*a*, while it is being sequentially bent over the outside surface 15 of the short segment 20 and over the outside surface 17 of a long segment 18 as is shown in FIGS. 5*b* and 5*c*. In this manner, one of the longitudinal clasp engaging portions 11 is formed on one edge of the decorative insert 14. FIG. 5*d* through 5*f* show the balance of the operation on the sheet metal piece 14', inserting the end 35 into the second slot 32, thereby forming the longitudinal clasp engaging portion 13 through the sequence of steps shown in FIGS. 5*d* through 5*f*.

The resulting housing 12 and decorative insert 14 are assembled as is shown in the cross-sectional view of FIG. 6, where the clasp portion 7 of the housing 12 engages the clasp engaging portion 11 of the decorative insert 14 and the clasp portion 9 of the housing engages the clasp engaging portion 13 of the decorative insert 14.

Figure 4J:
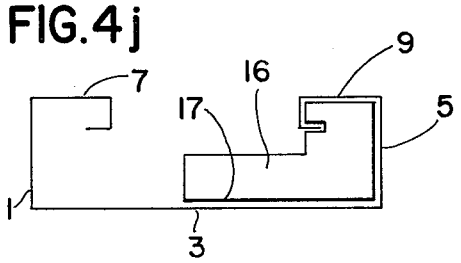

Sample dimensions for the second slot 32 include its opening being located 0.375 inches above the outer surface 17 of the long segment 18 of the tool. As is seen from FIG. 6, the separation distance between the sides g and g' of the insert 14 must be approximately the same as separation distance for the terminal ends of the segments a and a' for the housing 12 so that a proper fit is assured. With the sample dimensions given above for the tool 16, the length of the side h for the decorative insert 14 must be approximately ½ inch less than the length of the side 3 for the housing 12. Since clearance must be available between the long segment 18 of the tool 16 and the clasp portion 7 of the housing as is shown in FIGS. 4*i* and 4*j*, the minimum size for the side 3 of the housing 12 is approximately 2½ inches. Larger size trophies may be made by merely lengthening the size of the side 3 for the housing 12 and correspondingly the side h for the insert 14, without changing the dimensions of the tool.

FIG. 3 shows that a third slot 36, which is parallel with the first slot 28, may be provided in the inside surface 24 of the short segment 20. This enables the formation of a longitudinal clasp 7 which has a second segment b with a different dimension.

A modified embodiment of the invention is shown in FIG. 7 where a first auxiliary block 50 may be mounted or fastened in any manner to the outside surface 15 of the short segment 20 for enlarging the length of the end surface 26 thereof. In this manner, a longitudinal clasp 7 may be formed having the third segment c with a larger dimension. A second auxiliary block 60 may be mounted or fastened in any manner to the outside surface 17 of the long segment 18 for enlarging the length of the outside surface 15 of the short segment 20. In this manner, a longitudinal clasp 7 may be formed having the fourth segment d with a larger dimension.

Although a particular embodiment of the invention has been disclosed herein, workers of skill in the art would agree that changes can be made in the dimensions and in other minor details of the invention without departing from the spirit and the scope of the invention.

I claim:

1. A metal working hand tool for making a two-piece, four sided, metal trophy column having a housing formed from a first piece of sheet metal forming three of said sides with longitudinal clasp portions at the terminating edges of the first and third of said sides and a decorative insert formed from a second piece of sheet metal forming the fourth one of said sides with longitudinal clasp engaging portions at the terminating edges thereof which engage said clasps on said housing, comprising:

an L-shaped body having a long handle segment with a principal outside surface along a length direction and a short metal engaging segment with a principal outside surface along a width direction perpendicular to said length direction, the L-shaped body having a depth along a longitudinal direction mutually perpendicular to said length and width directions;

said short metal engaging segment having an inside surface parallel to said principal outside surface of said short segment and an end surface parallel with said principal outside surface of said long segment;

a first slot in said inside surface, parallel with said end surface, having a depth approximately equal to the length of a first segment of said longitudinal clasp portion, located at a distance from said end surface approximately equal to the length of a second segment of said longitudinal clasp portion, for securing a first end of said first piece of sheet metal while it is being sequentially bent over said inside surface, said end surface and said outside surface of said short segment and over said outside surface of said long segment, forming one of said longitudinal clasp portions on one edge of said first side of said housing;

said inside and outside surface of said short segment being separated by a distance approximately equal to the length of a third segment of said longitudinal clasp portion and said end surface of said short segment and said outside surface of said long segment being separated by a distance approximately equal to the length of said first side of said housing;

a second slot in said outside surface of said short segment, having an opening parallel with said outside surface of said long segment, having a depth approximately equal to the length of a first segment of said longitudinal clasp engaging portion, said depth being at an acute angle with respect to said outside surface of said long segment, located at a distance from said outside surface of said long segment approximately equal to the length of a second segment of said longitudinal clasp engaging portion, for securing a first end of said second piece of sheet metal while it is being sequentially bent over said outside surface of said short segment and said outside surface of said long segment, forming one of said longitudinal clasp engaging portions on one edge of said decorative insert;

whereby a two-piece metal trophy column may be made.

2. The apparatus of claim 1, which further comprises:

a third slot parallel with said first slot in said inside surface;

whereby a longitudinal clasp may be formed having said second segment with a different dimension.

3. The apparatus of claim 1, wherein said acute angle for said second slot is approximately 30°.

4. The apparatus of claim 1, wherein said long handle segment has a length less than the length of the second side of said housing.

5. The apparatus of claim 1, which further comprises:

a first auxiliary block mounted to said outside surface of said short segment for enlarging the length of said end surface;

whereby a longitudinal clasp may be formed having said third segment with a larger dimension.

6. The apparatus of claim 5, which further comprises:

a second auxiliary block mounted to said outside surface of said long segment for enlarging the length of said outside surface of said short segment;

whereby a longitudinal clasp may be formed having said fourth segment with a larger dimension.

7. A metal working method for making a two-piece, four sided, metal trophy column having a housing formed from a first piece of sheet metal forming three of said sides with longitudinal clasp portions at the terminating edges of the first and third of said sides and a decorative insert formed from a second piece of sheet metal forming the fourth one of said sides with longitudinal clasp engaging portions at the terminating edges thereof which engage said clasps on said housing, using an L-shaped body having a long handle segment with a principal outside surface along a length direction and a short metal engaging segment with a principal outside surface along a width direction perpendicular to said length direction, the L-shaped body having a depth along a longitudinal direction mutually perpendicular to said length and width directions, said short metal engaging segment having an inside surface parallel to said principal outside surface of said short segment and an end surface parallel with said principal outside surface of said long segment, comprising the steps of:

securing a first end of said first piece of sheet metal in a first slot in said inside surface, parallel with said end surface, having a depth approximately equal to the length of a first segment of said longitudinal clasp portion, located at a distance from said end surface approximately equal to the length of a second segment of said longitudinal clasp portion;

sequentially bending said first piece of sheet metal over said inside surface, said end surface and said outside surface of said short segment and over said outside surface of said long segment, forming one of said longitudinal clasp portions on one edge of said first side of said housing;

said inside and outside surfaces of said short segment being separated by a distance approximately equal to the length of a third segment of said longitudinal clasp portion and said end surface of said short segment and said outside surface of said long segment being separated by a distance approximately equal to the length of said first side of said housing;

securing a second end of said first piece of sheet metal opposite to said first end in said first slot and repeating said steps of sequentially bending forming a second one of said longitudinal clasp portions on one edge of said third side of said housing;

securing a first end of said second piece of sheet metal in a second slot in said outside surface of said short segment, having an opening parallel with said outside surface of said long segment, having a depth approximately equal to the length of a first segment of said longitudinal clasp engaging portion, said depth being at an acute angle with respect to said outside surface of said long segment, located at a distance from said outside surface of said long segment approximately equal to the length of a second segment of said longitudinal clasp engaging portion;

sequentially bending said second piece of sheet metal over said outside surface of said short segment and said outside surface of said long segment, forming one of said longitudinal clasp engaging portions on one edge of said decorative insert;

securing a second end of said second piece of sheet metal opposite to said first end thereof in said second slot and repeating said steps of sequential bending thereof forming a second one of said longitudinal clasp engaging portions on a second edge of said decorative insert;

whereby a two-piece metal trophy column may be made.

* * * * *